US005770015A

United States Patent [19]

Grossmann et al.

[11] Patent Number: 5,770,015

[45] Date of Patent: Jun. 23, 1998

[54] DRYING SECTION OF A PAPER MACHINE

[75] Inventors: Udo Grossmann; Albrecht Meinecke, both of Heidenheim; Hans Loser, Langenau, all of Germany

[73] Assignee: Voith Sulzer Papiermaschinen GmbH, Heidenheim, Germany

[21] Appl. No.: 583,047

[22] PCT Filed: May 10, 1995

[86] PCT No.: PCT/DE95/00601

§ 371 Date: Apr. 9, 1996

§ 102(e) Date: Apr. 9, 1996

[87] PCT Pub. No.: WO95/31601

PCT Pub. Date: Nov. 23, 1995

[30] Foreign Application Priority Data

May 11, 1994 [DE] Germany ..... 44 16 585.4

[51] Int. Cl.[6] ..... F26B 11/02

[52] U.S. Cl. ..... 162/359.1; 162/206; 162/361; 162/360.2; 34/114; 34/115; 34/117; 34/118; 34/121; 34/122

[58] Field of Search ..... 162/206, 359.1, 162/361, 360.2; 34/114, 115, 117, 121, 118, 122

[56] References Cited

U.S. PATENT DOCUMENTS

| | | | |
|---|---|---|---|
| 3,151,953 | 10/1964 | Justus | 34/118 |
| 3,319,352 | 5/1967 | Haigh | 162/206 |
| 3,354,035 | 11/1967 | Gottwald et al. | 162/206 |
| 4,461,095 | 7/1984 | Lehtinen | 34/41 |
| 4,622,758 | 11/1986 | Lehtinen et al. | 34/13 |
| 4,692,212 | 9/1987 | Swenson et al. | 162/206 |
| 5,291,666 | 3/1994 | Babinsky et al. | 162/206 |

FOREIGN PATENT DOCUMENTS

| | | | |
|---|---|---|---|
| 43 28 554 A1 | 3/1994 | Germany | D21F 5/04 |

OTHER PUBLICATIONS

Lehrbuch der Papier–und Kartonerzeugung/Autorenkollektiv, 2. edition, Leipzig, VEB Fachbuch–Verlag, 1987, pp. 286 and 287.

*Primary Examiner*—Peter Chin
*Attorney, Agent, or Firm*—Taylor & Associates, P.C.

[57] ABSTRACT

The invention is directed to a drying section of a paper machine for drying a fiber web. The drying section includes a plurality of drying groups, with each drying group having a plurality of heatable drying cylinders and a continuous hold-down belt. The hold-down belt has a longitudinal tension which biases the fiber web against the drying cylinders. The plurality of drying groups include at least one high-pressure group comprising a single-row drying group having one row of drying cylinders and one row of corresponding deflection rolls. The high-pressure group has a corresponding hold-down belt with a longitudinal tension which is at least 10 kN/m.

14 Claims, 3 Drawing Sheets

DRYING SECTION OF A PAPER MACHINE

The invention relates to a drying section of a paper machine with the features set forth in the preamble claim 1. Such a drying section is known from DE 43 28 554 A1. Drying sections of this prior design are suited particularly for paper machines operated at high speeds and intended for the production, e.g., of paper for graphical use. An essential characteristic of the prior drying section is that at least one single-row drying group is available. Such single-row drying group has only a single row of cylinders and between each two cylinders a deflection roll, which may be a suction roll. The paper web being dried is in such a single-row drying group carried constantly by a continuous hold-down belt (e.g., a drying wire) which, for one, forces the paper web on the drying cylinder and, for another, carries it from one drying cylinder across the following deflection roll to the next drying cylinder. This avoids running the paper web freely, i.e., without support, from one cylinder to the following cylinder. The risk of web break is distinctly reduced thereby.

The present invention now addresses the objective of proposing a drying section that is suited primarily for the production of relatively thick paper webs or of cardboard webs where—as compared to conventional drying sections—an increased strength of the finished web is achievable for these web grades.

This objective is accomplished according to the invention by application of the feature set forth in the characterizing part of claim 1. It has been recognized that a considerable compaction of the paper web can be achieved by application of an unusually high longitudinal tension of the hold-down belt (at least 10 kN/m) in a single-row drying group (a so-called "high-pressure group"), i.e., by the combination of the features of a particularly high contact pressure of the web on the cylinder and avoidance of unsupported web trains from cylinder to cylinder.

Such compaction yields an appreciable increase in the strength of the finished paper, and such increase in strength is evidenced, e.g., by the so-called ring crush test. (For comparison: customary so far in drying wires are longitudinal tensions of 3–5 kN/m; refer to Lehrbuch der Papier- und Kartonerzeugung/Autorenkollektiv [Textbook on Paper and Cardboard Production/Authors' Collective], 2. edition, Leipzig, VEB Fachbuch-Verlag, 1987, pp. 286 and 287.)

Especially good results in the purport of the above explanations are expected when using in the hold-down belt longitudinal tensions between 10 and 100 kN/m. Such high compaction can be achieved by selection (as compared to heretofore) of relatively small cylinder diameters, for example, of maximally 1 m. Moreover, a further improvement can be achieved by configuring the deflection rolls of the "high-pressure group" as suction rolls and adjusting the vacuum in the suction rolls to at least 0.5 m water column, preferably between 1 and 4 m water column.

In contrast to the single-row drying groups of the initially mentioned prior drying sections for graphical papers, configuring the high-pressure drying group as a single-row drying group is not required primarily for avoiding web breaks but, as explained above, in order to achieve in combination with the high longitudinal tension of the hold-down belt a high compaction of the web. Such web compaction need not take place across the entire length of the drying section but, for reason of space savings, may be restricted to the so-called major shrinking zone. This means that the remaining parts of the drying section can be configured in customary fashion, either entirely with two rows or as mixed single and double rows.

In other words: in a preferred embodiment of the invention, at least one conventional double-row drying group precedes the "high-pressure group" described above; the major task of the double-row group is building up heat in the web entering the drying section. But in drying relatively sensitive paper webs it may be suitable to provide in front of the double-row drying group still a conventional single-row drying group, where a relatively low longitudinal tension of the hold-down belt is used. With the conventional single-row drying group, thus, care is taken that the still relatively moist paper web coming directly from the press section (still with relatively low strength) is heated without the risk of web breaks.

According to a further idea concerning the embodiment of the invention, the "high-pressure group" may be followed as well by a conventional double-row drying group. This makes it possible with relatively limited need for space to adjust the desired final dry substance content for good in the paper web.

The invention can be used preferably in the production of relatively heavy paper grades, for example, of wrapping papers, corrugated raw papers and technical papers of various kinds, for example, abrasive belt backing paper.

The inventional compaction of the paper web may during the entire drying process take place in a single "high-pressure group." In this case, only a single continuous hold-down belt is provided for al drying cylinders of the "high-pressure group," which belt runs preferably across the upper area of the cylinder shells, so that only the underside of the web makes contact with the cylinder shells.

But two or more such "high-pressure groups" may also be arranged successively, so that the drying cylinders of all "high-pressure groups" make contact only with the underside of the web. This may be favorable when in the finished paper web a greater smoothness is desired on one of its two sides (hence, on its underside) than on the other side.

Contrarily, with approximately the same degree of smoothness desired on both web sides, it is better to arrange two different "high-pressure groups" successively, namely one where a first hold-down belt runs across the upper area of the cylinders, and a following group where a second hold-down belt runs across the lower area of the cylinders (or conversely). This measure, at the same time, holds out the expectation of a high compaction.

A further additional compaction of the paper web can be achieved by unusually high cylinder temperatures, for example by heating the cylinders (or part thereof) by means of steam or combustion of fuel gases. Additionally, as known as such, also "hot air blowing boxes" can be arranged yet, preferably in the zones where the web runs with the hold-down belt across the deflection rolls.

According to a further embodiment of the invention, the diameters of the heated drying cylinders may be approximately the same as the diameters of the reflection rolls fashioned as suction rolls. In other words: relatively small cylinders diameters are paired with relatively large suction roll diameters.

Achieved thereby, for one, is an especially high drying cylinder wraparound by the web, i.e., an increased heat transfer from the drying cylinders to the web. On the other hand, a relatively high rigidity of the suction roll shells is achieved at the same time, although these must be perforated, as is generally known. The suction rolls are thus better able to withstand the extremely high longitudinal tension of the hold-down belt as used according to the invention.

Several embodiments of the invention are described hereafter with the aid of the drawing.

Each of FIG. 1 through 4 shows a drying section as a schematic side elevation.

Fig. shows a drying section with the following structure:

Press section 1 is followed by a conventional single-row drying group 2, which is followed by an as well conventional double-row drying group 3 and by the inventional high-pressure group 4. The end is formed by a conventional double-row drying group 3. At the start of group 2, the fiber material web, e.g., paper web 8, is picked up by the drying section from the press section 1. This drying group 2 is "felted" at the top, i.e., the hold-down belt (e.g., drying wire 9 or drying felt) wraps around the upper part of drying cylinder 14 and around the deflection rolls, for instance, drying wire suction rolls 13, arranged between and below the drying cylinders 14.

The drying wire 9 is given only the usual, normal belt tension, which is symbolically indicated by a small arrow 16. In the following double-row drying group, the upper cylinders 14' are "felted" at the top and the lower drying cylinders 14" "felted" at the bottom. Here, too, the drying wire tension (arrow 16) corresponds to the values that have been customary so far. Following now is the inventional high-pressure group 4. It corresponds in terms of structure to the single-row, "top-felted" drying group 2, that is, the drying cylinders 11 are arranged at the top while the drying suction rolls 12 are arranged at the bottom. As opposed to the conventional single-row drying group 2, the drying cylinders 11 in the group 4 have a relatively small diameter, for example, of 1 m or less. In contract, the drying wire suction rolls 12 are considerably larger in diameter than in a conventional single-row drying group. Their diameter corresponds approximately to that of the drying cylinders 11. A further essential characteristic of this high-pressure group is the greatly elevated longitudinal tension of hold-down belt 9, which is symbolically represented by a large arrow 17.

The hold-down belt 9' may also be a drying wire. Because of the greater forces resulting from the elevated belt tension and acting on the drying wire guide rolls 7, the diameter of the latter is appreciably larger than the diameter of the guide rolls 10 of the other drying groups 2, 3 and 3'.

Following as termination of this drying section is then once again a conventional double-row drying group 3', which assumes then the final drying of the paper. The belt tension (arrow 16) is here again in the prior ranges. The paper web obtains here, in drying group 3, its final dry substance content.

FIG. 2 illustrates a different structure of a drying group. This structure is suited preferably for heavy papers and cardboard. The fiber material web 8 approaching from press section 1 enters first a double-row 3 with conventional drying wire tension 16. Following thereafter is a first high-pressure group 4, which is felted at the top. The drying wire 9 is subjected to an elevated belt tension 17. Following this drying group is a second high-pressure group 5, which is felted at the bottom, though. Following as termination of this drying section is a conventional double-row drying group 3, which imparts to the fiber material web its final dry substance content.

FIG. 3 shows a further variant of a drying section with high-pressure group 4. After the press section 1, the fiber material web 8 is dried in at least two single-row, top-felted drying groups 2 and 2'. Only thereafter is the web dried in at least one high-pressure group 4, which is followed—as in FIG. 1 or 2—by a not illustrated conventional double-row drying group.

A further variant is shown in FIG. 4. The fiber material web is dried first by a single-row top-felted drying group 2. Following this sparing initial drying is a further, more intensive drying by a double-row drying group 3. Said group is followed in the so-called major shrinking zone by at least one, as well double-row drying group 6, in which the upper and lower drying wires carry the high tension according to the invention (heavy arrows 17). This necessitates the larger diameters of the drying wire guide rolls 7 (refer to claim 15). The drying section may be terminated again by a not illustrated conventional double-row drying group.

We claim:

1. A drying section of a paper machine for drying a fiber web, said drying section comprising:

a plurality of consecutively arranged drying groups, each said drying group including a plurality of heatable drying cylinders, a continuous hold-down belt carrying said web and associated with each of said drying cylinders, and means for applying a longitudinal tension to said hold-down belt, said hold-down belt for biasing the fiber web against said drying cylinders, said plurality of drying groups including at least one high-pressure group comprising a single-row drying group having one row of drying cylinders and one row of corresponding deflection rolls, said hold-down belt being positioned to carry said web by partially wrapping alternate respective ones of said drying cylinders and said deflection rolls, said hold-down belt positioned to press the fiber web into direct contact with each of said drying cylinders of said high pressure group, each said deflection roll of said high pressure group having an internal suction device defining a suction zone, said internal suction device being positioned for directly contacting and exerting a suction on the fiber web, said tension applying means of said high-pressure group applying a longitudinal tension of at least 10 kN/m to said hold-down belt of said high-pressure group.

2. The drying section of claim 1, wherein said hold-down belt of said high-pressure group has a corresponding said longitudinal tension which is between approximately 15 to 100 kN/m.

3. The drying section of claim 1, wherein said drying cylinders of said high-pressure group have a diameter of not greater than approximately 1 m.

4. The drying section of claim 1, wherein said deflection rolls of said high-pressure group comprise suction rolls having a vacuum therein of at least 0.5 m water column.

5. The drying section of claim 4, wherein said suction rolls have a vacuum therein of between approximately 1 to 4 m water column.

6. The drying section of claim 1, further comprising at least one double-row drying group disposed before said high-pressure group, relative to a direction travel of the fiber web.

7. The drying section of claim 6, further comprising at least one double-row drying group disposed before said high-pressure group, relative to a direction of travel of the fiber web, and further comprising a press section disposed before said high-pressure group, relative to a direction of travel of the fiber web.

8. The drying section of claim 1, further comprising at least one double-row drying group disposed after said high-pressure group, relative to a direction of travel of the fiber web.

9. The drying section of claim 1, wherein said high-pressure group has a single said hold-down belt.

10. The-drying section of claim 1, wherein said hold-down belt contacts an upper area of said drying cylinders of said high-pressure group.

11. The drying section of claim 1, further comprising a second high pressure group having one row of drying cylinders an one row of corresponding deflection rolls and a second hold down belt positioned to carry said web by partially wrapping alternate respective ones of said drying cylinders and said deflection rolls positioned to press the fiber web into direct contact with each of said drying cylinders of said second high pressure group, each of said deflection roll of said second high pressure group having internal suction device defining a suction zone, said internal suction device being positioned for directly contacting and exerting suction on the fiber web, tension means for applying a longitudinal tension of at least 10 kN/m to said second hold down belt, said hold-down belt of one of said high-pressure groups contacting an upper area of corresponding said drying cylinders, and said second hold-down belt of said second high-pressure groups contacting a lower area of corresponding said drying cylinders.

12. The drying section of claim 1, wherein said drying cylinders of said high-pressure group have a diameter which is approximately equal to a diameter of said deflection rolls of said high-pressure group.

13. The drying section of claim 1, further comprising means for heating said drying cylinders of said high-pressure group to an outside temperature of at least 130° C.

14. The drying section of claim 1, further comprising means for heating said drying cylinders of said high-pressure group to an outside temperature of at least 150° C.

* * * * *

UNITED STATES PATENT AND TRADEMARK OFFICE

CERTIFICATE OF CORRECTION

PATENT NO. : 5,770,015
DATED : June 23, 1998
INVENTOR(S) : Grossmann et al.

It is certified that error appears in the above-identified patent and that said Letters Patent is hereby corrected as shown below:

Please delete columns 1-6 and substitute columns 1-6 as per attached.

Signed and Sealed this

Nineteenth Day of November, 2002

*Attest:*

*Attesting Officer*

JAMES E. ROGAN
*Director of the United States Patent and Trademark Office*

DRYING SECTION OF A PAPER MACHINE

BACKGROUND OF THE INVENTION

1. Field of the Invention

The present invention relates to a drying section of a paper machine, and, more particularly, to a drying section having a plurality of drying groups.

2. Description of the Related Art

A drying section of known design is disclosed by German Patent No. DE 43 28 554 A1. Such a drying section is suited particularly for paper machines operated at high speeds and intended for the production, e.g., of paper for graphical use. An essential characteristic of this drying section is that at least one single-row drying group is available. Such a single-row drying group has only a single row of cylinders and between each two cylinders a deflection roll, which may be a suction roll. The paper web being dried in the single-row drying group is carried constantly by a continuous hold-down belt (e.g., a drying wire) which, for one, forces the paper web on the drying cylinder and, for another, carries it from one drying cylinder across the following deflection roll to the next drying cylinder. This avoids running the paper web freely, i.e., without support, from one cylinder to the following cylinder. The risk of web break is distinctly reduced thereby.

SUMMARY OF THE INVENTION

The present invention uses a drying section that is suited primarily for the production of relatively thick paper webs or of cardboard webs where—as compared to conventional drying sections—an increased strength of the finished web is achievable for these web grades.

The inventors have found that a considerable compaction of the paper web can be achieved by application of an unusually high longitudinal tension of the hold-down belt (at least 10 kN/m) in a single-row drying group (a so-called "high-pressure group"), i.e., resulting in a particularly high contact pressure of the web on the cylinder and avoidance of unsupported web trains from cylinder to cylinder. Such compaction yields an appreciable increase in the strength of the finished paper, and such increase in strength is evidenced, e.g., by the so-called ring crush test. (For comparison: customary so far in drying wires are longitudinal tensions of 3–5 kN/m; refer to Lehrbuch der Papier- und Kartonerzeugung/Autorenkollektiv [Textbook on Paper and Cardboard Production/Authors' Collective], 2. edition, Leipzig, VEB Fachbuch-Verlag, 1987, pp. 286 and 287.)

Especially good results are realized when using in the hold-down belt longitudinal tensions between 10 and 100 kN/m. A still further compaction can be achieved by selection (as compared to heretofore) of relatively small cylinder diameters, for example, of maximally 1 m. Moreover, a further improvement can be achieved by configuring the deflection rolls of the "high-pressure group" as suction rolls and adjusting the vacuum in the suction rolls to at least 0.5 m water column, preferably between 1 and 4 m water column.

In contrast to the above-described single-row drying groups of drying sections for graphical papers, configuring the high-pressure drying group as a single-row drying group is not required primarily for avoiding web breaks but, as explained above, in order to achieve in combination with the high longitudinal tension of the hold-down belt a high compaction of the web. Such web compaction need not take place across the entire length of the drying section but, for reason of space savings, may be restricted to the so-called major shrinking zone. This means that the remaining parts of the drying section can be configured in customary fashion, either entirely with two rows or as mixed single and double rows.

In one embodiment of the invention, at least one conventional double-row drying group precedes the "high-pressure group" described above; the major task of the double-row group is building up heat in the web entering the drying section. But in drying relatively sensitive paper webs it may be suitable to provide in front of the double-row drying group a conventional single-row drying group, where a relatively low longitudinal tension of the hold-down belt is used. With the conventional single-row drying group, thus, care is taken that the still relatively moist paper web coming directly from the press section (still with relatively low strength) is heated without the risk of web breaks.

According to a further idea concerning the embodiment of the invention, the "high-pressure group" may be followed as well by a conventional double-row drying group. This makes it possible with relatively limited need for space to adjust the desired final dry substance content in the paper web.

The invention can be used preferably in the production of relatively heavy paper grades, for example, of wrapping papers, corrugated raw papers and technical papers of various kinds, for example, abrasive belt backing paper.

The inventional compaction of the paper web may during the entire drying process take place in a single "high-pressure group." In this case, only a single continuous hold-down belt is provided for all drying cylinders of the "high-pressure group," which belt runs preferably across the upper area of the cylinder shells, so that only the underside of the web makes contact with the cylinder shells.

Further, two or more such "high-pressure groups" may also be arranged successively, so that the drying cylinders of all "high-pressure groups" make contact only with the underside of the web. This may be favorable when in the finished paper web a greater smoothness is desired on one of its two sides (hence, on its underside) than on the other side.

Contrarily, with approximately the same degree of smoothness desired on both web sides, it is better to arrange two different "high-pressure groups" successively, namely one where a first hold-down belt runs across the upper area of the cylinders, and a following group where a second hold-down belt runs across the lower area of the cylinders (or conversely). This measure, at the same time, holds out the expectation of a high compaction.

A further additional compaction of the paper web can be achieved by unusually high cylinder temperatures, for example by heating the cylinders (or part thereof) by means of steam or combustion of fuel gases. Additionally, as known as such, also "hot air blowing boxes" can be arranged yet, preferably in the zones where the web runs with the hold-down belt across the deflection rolls.

According to a further embodiment of the invention, the diameters of the heated drying cylinders may be approximately the same as the diameters of the reflection rolls fashioned as suction rolls. In other words, relatively small cylinder diameters are paired with relatively large suction roll diameters.

Achieved thereby, for one, is an especially high drying cylinder wraparound by the web, i.e., an increased heat transfer from the drying cylinders to the web. On the other hand, a relatively high rigidity of the suction roll shells is achieved at the same time, although these must be perforated, as is generally known. The suction rolls are thus better able to withstand the extremely high longitudinal tension of the hold-down belt as used according to the invention.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
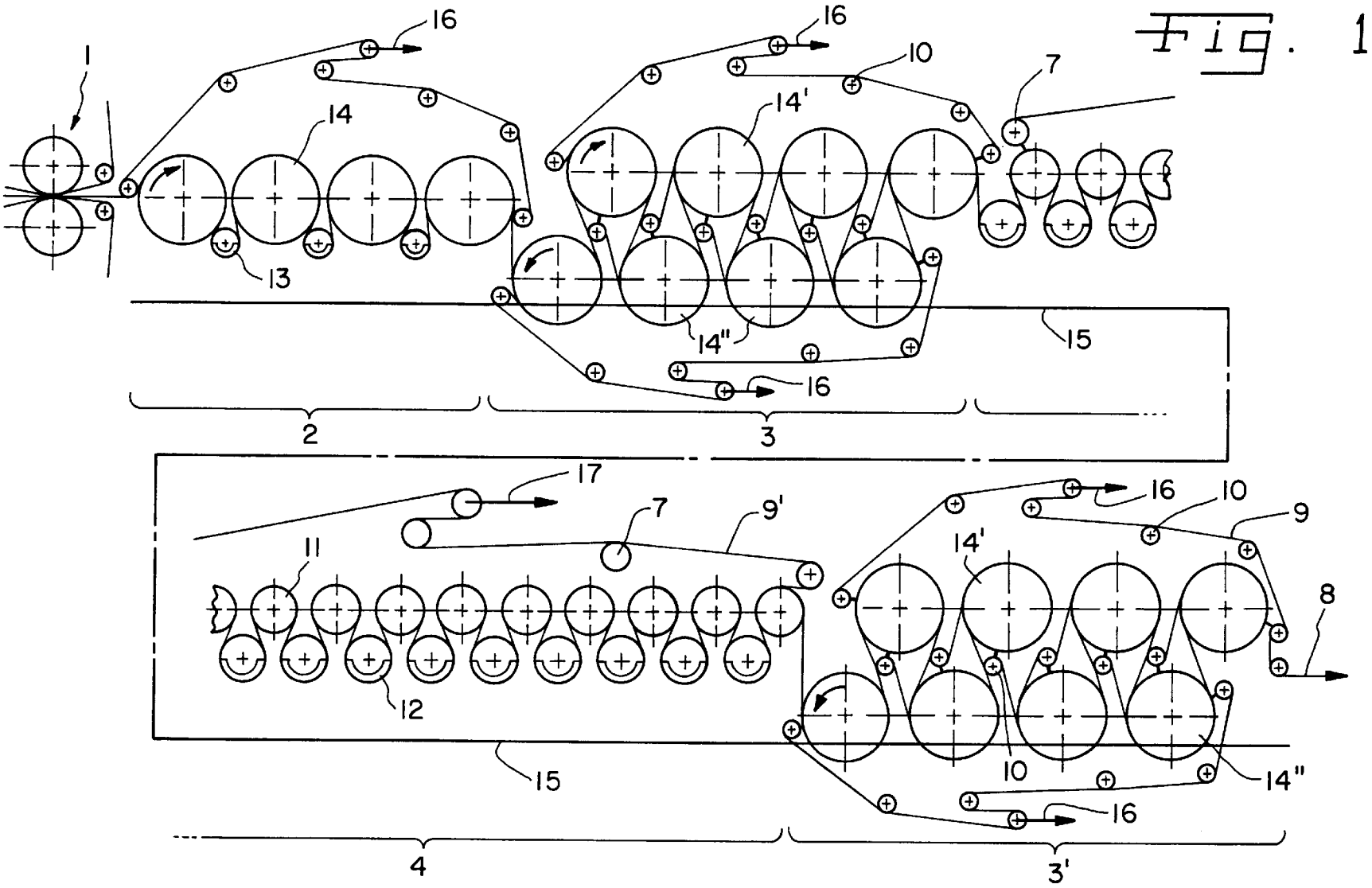
FIG. 1 is a schematical, side elevational view of one embodiment of a dryer section of the present invention.

Referring now to the drawings, and particularly to FIG. 1, a press section 1 is followed by a conventional single-row drying group 2, which is followed by an as well conventional double-row drying group 3 and by the inventional high-pressure group 4. The end is formed by a conventional double-row drying group 3. At the start of group 2, the fiber material web, e.g., paper web 8, is picked up by the drying section from the press section 1. This drying group 2 is "felted" at the top, i.e., the hold-down belt (e.g., drying wire 9 or drying felt) wraps around the upper part of drying cylinder 14 and around the deflection rolls, for instance, drying wire suction rolls 13, arranged between and below the drying cylinders 14.

Drying wire 9 is given only the usual, normal belt tension, which is symbolically indicated by a small arrow 16. In the following double-row drying group 3, the upper cylinders 14' are "felted" at the top and the lower drying cylinders 14" are "felted" at the bottom. Here, too, the drying wire tension (arrow 16) corresponds to the values that have been customary so far.

Following double-row drying group 3 is the inventional high-pressure group 4. It corresponds in terms of structure to the single-row, "top-felted" drying group 2, that is, the drying cylinders 11 are arranged at the top while the drying suction rolls 12 are arranged at the bottom. However, as opposed to the conventional single-row drying group 2, the drying cylinders 11 in group 4 have a relatively small diameter, for example, of 1 m or less. In contrast, the drying wire suction rolls 12 are considerably larger in diameter than in a conventional single-row drying group. The diameter of drying wire suction rolls 12 corresponds approximately to that of drying cylinders 11. A further essential characteristic of high-pressure group 4 is the greatly elevated longitudinal tension of hold-down belt 9', which is symbolically represented by a large arrow 17.

Hold-down belt 9' may also be in the form of a drying wire. Because of the greater forces resulting from the elevated belt tension and acting on the drying wire guide rolls 7, the diameter of rolls 7 is appreciably larger than the diameter of guide rolls 10 of the other drying groups 2, 3 and 3'.

Following as termination of this drying section is then once again a conventional double-row drying group 3', which assumes then the final drying of the paper. The belt tension (arrow 16) is here again in the prior ranges. The paper web obtains here, in drying group 3', its final dry substance content.

Figure 2:
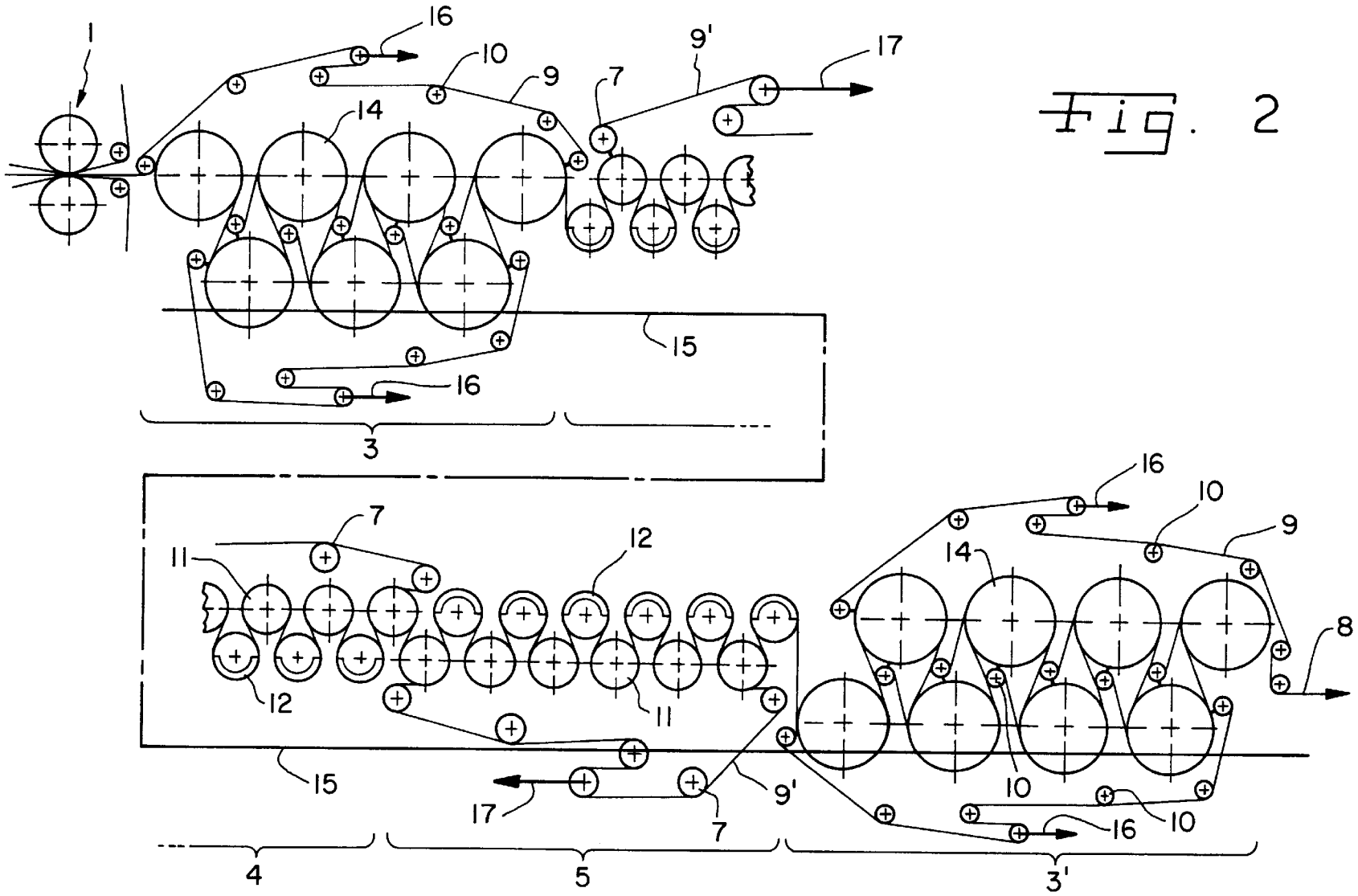
FIG. 2 is a schematical, side elevational view of another embodiment of a dryer section of the present invention.

FIG. 2 illustrates a different structure of a drying group. This structure is suited preferably for heavy papers and cardboard. The fiber material web 8 approaching from press section 1 enters first a double-row-drying group 3 with conventional drying wire tension 16. Following thereafter is a first high-pressure group 4, which is felted at the top. The drying wire 9 is subjected to an elevated belt tension 17. Following this drying group is a second high-pressure group 5, which is felted at the bottom, though. Following as termination of this drying section is a conventional double-row drying group 3', which imparts to the fiber material web its final dry substance content.

Figure 3:
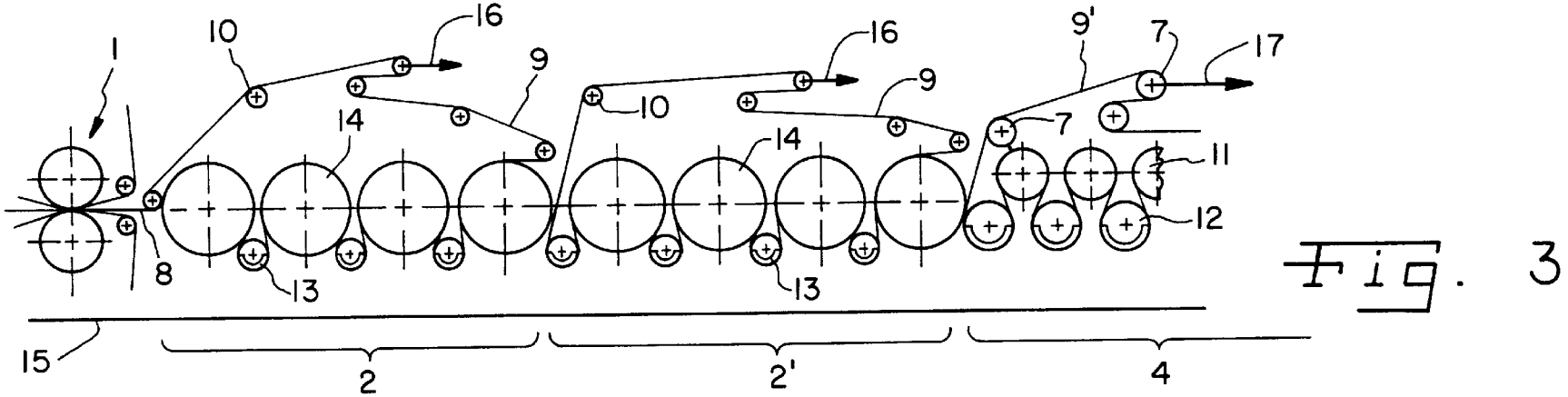
FIG. 3 is a schematical, side elevational view of yet another embodiment of a dryer section of the present invention.

FIG. 3 shows a further variant of a drying section with high-pressure group 4. After the press section 1, the fiber material web 8 is dried in at least two single-row, top-felted drying groups 2 and 2'. Only thereafter is the web dried in at least one high-pressure group 4 (shown in part in FIG. 3), which is followed—as in FIG. 1 or 2—by a not illustrated conventional double-row drying group.

Figure 4:
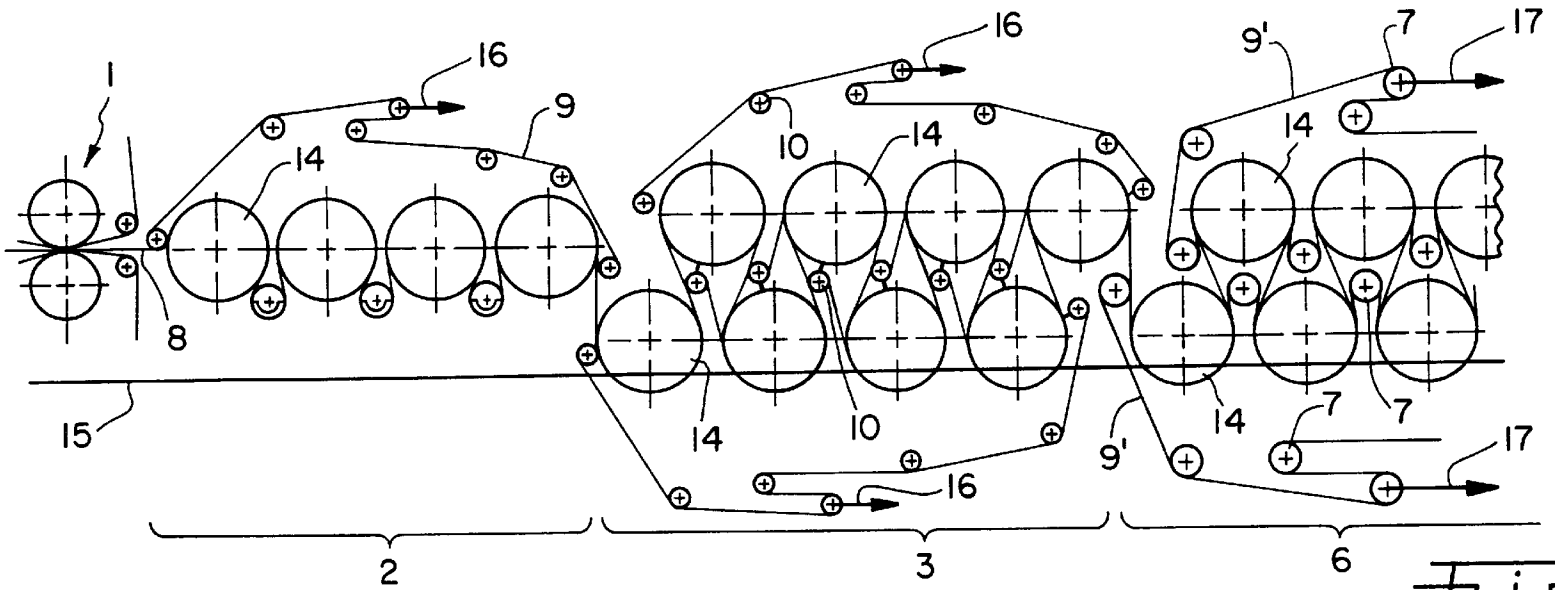
FIG. 4 is a schematical, side elevational view of a further embodiment of a dryer section of the present invention.

A further variant is shown in FIG. 4. The fiber material web is dried first by a single-row top-felted drying group 2. Following drying group 2 is a further, more intensive drying by a double-row drying group 3. Group 3 is followed in the so-called major shrinking zone by at least one double-row drying group 6 (shown in part in FIG. 4), in which the upper and lower drying wires 9' carry the high tension according to the invention (heavy arrows 17). This necessitates the larger diameters of the drying wire guide rolls 7. The drying section may be terminated again by a conventional double-row drying group (not illustrated).

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

We claim:

1. A drying section of a paper machine for drying a fiber web, said drying section comprising:

a plurality of consecutively arranged drying groups, each said drying group including a plurality of heatable drying cylinders, a continuous hold-down belt carrying said web and associated with each of said drying cylinders, and means for applying a longitudinal tension to said hold-down belt, said hold-down belt for biasing the fiber web against said drying cylinders, said plurality of drying groups including at least one high-pressure group comprising a single-row drying group having one row of drying cylinders and one row of corresponding deflection rolls, said hold-down belt being positioned to carry said web by partially wrapping alternate respective ones of said drying cylinders and said deflection rolls, said hold-down belt positioned to press the fiber web into direct contact with each of said drying cylinders of said high pressure group each said deflection roll of said high pressure group having an internal suction device defining a suction zone, said internal suction device being positioned for directly contacting said hold-down belt and exerting a suction on the fiber web, said tension applying means of said high-pressure group applying a longitudinal tension of at least 10 kN/m to said hold-down belt of said high-pressure group.

2. The drying section of claim 1, wherein said hold-down belt of said high-pressure group has a corresponding said longitudinal tension which is between approximately 15 to 100 kN/m.

3. The drying section of claim 1, wherein said drying cylinders of said high-pressure group have a diameter of not greater than approximately 1 m.

4. The drying section of claim 1, wherein said deflection rolls of said high-pressure group comprise suction rolls having a vacuum therein of at least 0.5 m water column.

5. The drying section of claim 4, wherein said suction rolls have a vacuum therein of between approximately 1 to 4 m water column.

6. The drying section of claim 1, further comprising at least one double-row drying group disposed before said high-pressure group, relative to a direction of travel of the fiber web.

7. The drying section of claim 6, further comprising at least one double-row drying group disposed before said high-pressure group, relative to a direction of travel of the fiber web, and further comprising a press section disposed before said high-pressure group, relative to a direction of travel of the fiber web.

8. The drying section of claim 1, further comprising at least one double-row drying group disposed after said high-pressure group, relative to a direction of travel of the fiber web.

9. The drying section of claim 1, wherein said high-pressure group has a single said hold-down belt.

10. The drying section of claim 1, wherein said hold-down belt contacts an upper area of said drying cylinders of said high-pressure group.

11. The drying section of claim 1, further comprising a second high pressure group having one row of drying cylinders and one row of corresponding deflection rolls and a second hold down belt positioned to carry said web by partially wrapping alternate respective ones of said drying cylinders and said deflection rolls positioned to press the fiber web into direct contact with each of said drying cylinders of said second high pressure group, each of said deflection roll of said second high pressure group having internal suction device defining a suction zone, said internal suction device being positioned for directly contacting and exerting suction on the fiber web, tension means for applying a longitudinal tension of at least 10 kN/m to said second hold down belt, said hold-down belt of one of said high-pressure groups contacting an upper area of corresponding said drying cylinders, and said second hold-down belt of said second high-pressure groups contacting a lower area of corresponding said drying cylinders.

12. The drying section of claim 1, wherein said drying cylinders of said high-pressure group have a diameter which is approximately equal to a diameter of said deflection rolls of said high-pressure group.

13. The drying section of claim 1, further comprising means for heating said drying cylinders of said high-pressure group to an outside temperature of at least 130° C.

14. The drying section of claim 1, further comprising means for heating said drying cylinders of said high-pressure group to an outside temperature of at least 150° C.

* * * * *